US010640851B2

(12) United States Patent
Purnell et al.

(10) Patent No.: US 10,640,851 B2
(45) Date of Patent: May 5, 2020

(54) ALUMINIUM ALLOY PRODUCTS HAVING A PRE-SINTERED DENSITY OF AT LEAST 90% THEORETICAL, AND METHODS OF MAKING SUCH ALLOY PRODUCTS

(71) Applicants: Charles Grant Purnell, Wantage (GB); Henry Dickinson, Charlton (GB)

(72) Inventors: Charles Grant Purnell, Wantage (GB); Henry Dickinson, Charlton (GB)

( * ) Notice: Subject to any disclaimer, the term of this patent is extended or adjusted under 35 U.S.C. 154(b) by 785 days.

(21) Appl. No.: 14/889,799

(22) PCT Filed: May 7, 2014

(86) PCT No.: PCT/GB2014/000176

§ 371 (c)(1),
(2) Date: Apr. 5, 2016

(87) PCT Pub. No.: WO2014/181073

PCT Pub. Date: Nov. 13, 2014

(65) Prior Publication Data

US 2016/0102388 A1 Apr. 14, 2016

(30) Foreign Application Priority Data

May 7, 2013 (GB) ..... 1308195.5

(51) Int. Cl.

| | |
|---|---|
| ***B32B 5/16*** | (2006.01) |
| ***C22C 21/02*** | (2006.01) |
| ***C22C 1/04*** | (2006.01) |
| ***B22F 3/12*** | (2006.01) |
| ***B22F 3/26*** | (2006.01) |
| ***B22F 9/08*** | (2006.01) |
| ***C22C 21/00*** | (2006.01) |
| ***C22C 21/14*** | (2006.01) |
| ***C22C 21/16*** | (2006.01) |
| ***C25D 11/04*** | (2006.01) |

(52) U.S. Cl.

CPC ..... *C22C 21/02* (2013.01); *B22F 3/12* (2013.01); *B22F 3/26* (2013.01); *B22F 9/08* (2013.01); *C22C 1/0416* (2013.01); *C22C 21/00* (2013.01); *C22C 21/14* (2013.01); *C22C 21/16* (2013.01); *C25D 11/04* (2013.01); *B22F 2998/10* (2013.01); *B22F 2999/00* (2013.01)

(58) Field of Classification Search

CPC ..... C22C 1/0416; C22C 21/02
USPC ..... 420/534, 529, 533, 537, 542, 546, 528, 420/548

See application file for complete search history.

(56) References Cited

U.S. PATENT DOCUMENTS

| | | | | |
|---|---|---|---|---|
| 4,970,049 | A | 11/1990 | Baker et al. | |
| 5,188,659 | A | 2/1993 | Purnell et al. | |
| 5,466,277 | A | 11/1995 | Miura et al. | |
| 5,613,184 | A * | 3/1997 | Purnell | B22F 1/0003 419/38 |
| 6,468,468 | B1 * | 10/2002 | Neubing | C22C 1/0416 419/38 |
| 2013/0101456 | A1 * | 4/2013 | Danninger | B22F 3/1021 419/30 |

FOREIGN PATENT DOCUMENTS

| | | | |
|---|---|---|---|
| JP | 53125913 | A | 11/1978 |
| JP | 53125913 | A | 11/1978 |
| JP | 53128512 | A | 11/1978 |
| JP | 03784858 | B | 1/1997 |
| JP | 20005048285 | A | 2/2005 |
| WO | WO 94/29489 | | 12/1994 |
| WO | WO 02/207047 | | 4/2002 |

OTHER PUBLICATIONS

'Development of an Aluminium PM Alloy for "Press-Sinter-Size" Technology' Authors: Christopher Boland et al International Journal of Powder Metallurgy, vol. 47, Issue 1, 2011, pp. 39-48. vol. 11, Issue 1, 2011.

GB2513869 Search Report.

PCT/GB2014/000176 ISA Written Opinion dated Apr. 2007.

Title: Influence of Porosity on the Characteristics of Sintered Materials. Publication 1982: International Journal of Powder Metallurgy vol. 22, pp. 185-202. Author: Bocchini G. F. (Bocchini G.F. , International Journal of Powder Metallury 22 p. 185-202.

* cited by examiner

*Primary Examiner* — Hoa (Holly) Le
(74) *Attorney, Agent, or Firm* — Robert W J Usher

(57) ABSTRACT

Aluminium-silicon powder mixtures comprising a hypereutectic Al—Si powder, a near eutectic Al—Si powder, and a third powder which is aluminium or a hypoeutectic aluminium alloy containing alloying constituents other than silicon and less than 9 wt % silicon, with a sintering aid comprising a fourth, zinc-containing powder, are pressed and sintered to provide powder metallurgy products suitable for automotive component use in particular. The third powder in the composition permits such Al—Si powder mixtures to be compressed to a density approaching that obtained by use of an annealed powder mixture, but without the annealing step.

16 Claims, 5 Drawing Sheets

ALUMINIUM ALLOY PRODUCTS HAVING A PRE-SINTERED DENSITY OF AT LEAST 90% THEORETICAL, AND METHODS OF MAKING SUCH ALLOY PRODUCTS

TECHNICAL FIELD

This invention relates to aluminium alloy products, and to methods of making such alloy products. More particularly, the invention concerns aluminium alloy products that can be made by a powder metallurgy route, using press and sinter methods.

The invention further extends to metal powder source materials comprising mixtures of aluminium-containing powders for use in such methods, and to green pressed pre-sintered products.

The production of aluminium-silicon (Al—Si) alloys by means of powder metallurgical techniques is useful for the manufacture of a range of components intended for applications in the automotive and other industries.

BACKGROUND OF THE INVENTION

Al—Si alloys exhibit a eutectic reaction with the liquidus/solidus temperatures equal at about 11% Si by weight, with some modification when other alloying elements are present. Hypoeutectic alloys, i.e. those with lower silicon content than eutectic, generally exhibit primary aluminium particles in a two-phase eutectic, as do eutectic alloys. Hypereutectic alloys, i.e. those with higher silicon content, exhibit primary Si particles in a two-phase eutectic. The presence of primary Si particles is beneficial for resistance to galling (adhesive wear) and for hardness. In contrast to the situation in cast products, in which these particles can be gross and angular, adversely affecting mechanical properties and machinability, atomized Al—Si hypereutectic powder contains primary Si particles which are refined and cuboid with a 5 to 10 micrometre average particle size, which are considered to be optimal for wear resistance and machinability. Further, precipitates arising from the presence of impurities, such as the β-AlFeSi phase, which can arise in cast products, are not significant in atomized powders.

Further background is given in WO94/29489, which discloses and discusses the use of mixtures of hypereutectic and near-eutectic aluminium-silicon powders to obtain pressed and sintered powdered metal, and in WO02/27047, which discloses the use of zinc or zinc-based powder as a sintering aid for such mixtures. As evidenced by FIG. 3 of the latter publication, the as-atomized powder mixtures are not easily compressible, a situation which is markedly improved by annealing the powders. However, and significantly in industrial applications, an annealing step will incur additional manufacturing cost.

SUMMARY OF THE INVENTION

This invention addresses means of improving the compressibility of such aluminium-silicon powder mixtures prior to sintering, and provides pressed and sintered powder metallurgy products, methods of making the same, and novel source materials for use in said methods.

In this aspect, the hypereutectic and near eutectic Al—Si powder mixture is supplemented with a third powder which is an aluminium or aluminium-based powder. By this means, we have found that it is possible to improve the compressibility of such mixtures and obtain a pressed density approaching or equalling that obtained by use of an annealed powder mixture. In consequence, production costs can be reduced.

In this specification, reference is made to near-eutectic and hypereutectic aluminium-silicon (Al—Si) alloys. These terms have the same meaning as set out in WO94/29489, noted above, where the term "near-eutectic" refers to an aluminium alloy containing from 9 to 13 wt % of silicon, and a hypereutectic aluminium-silicon based alloy is defined as comprising more than 13 wt % of silicon. The position of the eutectic point is influenced to a minor extent by additional alloying elements and by the solidification parameters experienced by the powder during manufacture.

In a first aspect of the invention, there is provided a metal powder source material for making an aluminium-based sintered product by a powder metallurgy route, comprising a mixture of first, second and third aluminium-containing powders, as set out in claim 1.

In a second aspect of the invention, there is provided a metal powder mix suitable for making an aluminium-based sintered product by a powder metallurgy route, comprising a metal powder source material as aforesaid mixed with a zinc-containing sintering aid, as set out in claim 11.

In a third aspect of the invention, there is provided a green pressed composite formed by shaping and compacting a metal powder mix as aforesaid, and to green pressed composites thereof ready-formed for sintering.

In further aspects of the invention, there are provided powder metallurgy products, and automotive components, as further described and claimed herein.

In a further aspect of the present invention which utilizes the source material and powder mix noted above, there is provided a method of making an aluminium-based sintered product by a powder metallurgy route, comprising producing a mixture of first, second and third aluminium-containing powders and a sintering aid comprising a fourth, zinc-containing powder, compacting the mixture, and sintering the compacted mixture to produce the product; wherein the first powder is of a hypereutectic aluminium-silicon-copper-magnesium alloy, the second powder is of a near-eutectic aluminium-silicon alloy containing from 9 to 13 wt % silicon, the third powder is of aluminium or a hypoeutectic aluminium alloy containing alloying constituents other than silicon and less than 9 wt % silicon, and the fourth powder is a sintering aid comprising zinc or a zinc-based alloy; the first and second powders being present in relative proportions to one another lying in the range 35:65 wt % to 65:35 wt %, the third powder being present in a proportion of up to 35 wt % of the total weight of the three said aluminium-containing powders, and the zinc-containing powder being present as at least 0.5 wt % of the total metal powder mixture.

The first and second aluminium-containing powders are usually powders that have been produced by an atomization process, typically water or gas atomization. This procedure for powder formation tends to produce the hard powders that are less readily compressible in the compaction step prior to sintering. The method according to the invention may accordingly further comprise producing the first aluminium-containing powder by an atomizing step, or producing the second aluminium-containing powder by an atomizing step, or both. These powders may be used in the invention without having been subsequently annealed, with corresponding benefits in terms of costs and processing steps.

The third powder, which may be an aluminium-based powder as set out above, or substantially pure aluminium (typically 99.7% purity), may also be atomized, but will be soft and readily compactible. In most instances of the third, hypoeutectic powder, silicon will not be present as a major alloying element, but only as an incidental constituent, typically present at less than 0.6 wt %, and in many cases less than 0.3 wt %. However, it is conceivable that the silicon content can in some cases approach as much as 9 wt %.

Gas- and water-atomized aluminium powders used in press and sinter powder metallurgy in general, as also in the present invention, usually have a mean powder particle size of from 25 to 100 micrometre (μm). Finer powders are generally not used, except in special cases such as metal injection moulding, a completely distinct processing method.

We have found that components can be produced using the method of the invention, incorporating a hypereutectic Al—Si—Cu—Mg powder, a near eutectic powder, and a third aluminium powder, have improved hardness and other mechanical properties and pressed densities, compared to mixtures of non-annealed or even annealed powders of near-eutectic and hypereutectic powders without Cu—Mg content. Where atomized Al—Si powders are used, the cost of annealing may be avoided.

Furthermore, the third aluminium powder may be one that is significantly less costly than the first and second powders, having fewer alloying additions, thereby conferring substantial further economic advantage on the methods of the invention.

In the hypereutectic Al—Si—Cu—Mg first powder, the copper content is preferably at least 1 wt %, and more preferably at least 2 wt %; and the magnesium content is preferably at least 0.2 wt %. Normally, the copper content is not more than 6 wt %, and the magnesium content is not more than 1 wt %.

The third aluminium-based powder, which as noted is included in a proportion of up to 35 wt % of the total of the first three powders, is desirably present as at least 5 wt % of that total, and more preferably at least 10 wt %.

The fourth powder, comprising zinc or a zinc-based alloy, may suitably form 1 to 7 or 8 wt %, more preferably 2 to 6 wt %, of the total metal powder mixture. This powder preferably has a powder size in the range from 30 to 150 micrometres. This powder may be a zinc powder containing iron in solid solution. In some cases, residue from galvanizing operations can provide an economic source of suitable powder.

It is usual to include a solid fugitive pressing lubricant in the powder mixture before compaction. Conventional commercially available pressing lubricants include Acrawax® (Lonza, Inc.) and Kenolube® (Höganäs AB).

The method may also further comprise incorporating from 1 to 5 wt % of a solid lubricant into the powder before the compaction step. Such a lubricant is useful for improving the lubricity of sintered products destined for use as bushings and the like. In a preferred embodiment of the invention, a solid lubricant that is used is graphite.

In pressed and sintered metal products of density less than 90% of theoretical, the porosity is generally interconnected. In order to increase the density, or to define dimensions in the component being formed, the product may be restruck after sintering. This process is also called sizing. In carrying out the present invention, the method may include the further step of re-striking the sintered product to densify it. Where the density of the pressed and sintered product is significantly greater than 90% of theoretical, the porosity tends to be closed and not fully interconnected.

In cases in which the method of the invention gives rise to interconnected porosity but does not include re-striking, the method may include the further step of impregnating the product with an oil or a sealant. Oil impregnation is commonly used in powder metallurgy products such as valve guides or self-lubricating bearings to give lubricity in marginally lubricated applications. Impregnation with sealants may be carried out to seal against passage of gases or liquids, as is commonly applied to aluminium cylinder heads or to pumps for liquids.

The method may also include the further step of surface treating the pressed and sintered product, for example by anodizing or conversion coating to improve frictional and wear resisting properties.

Components manufactured according to the method of the invention exhibit microstructures limited by solid state diffusion, of reticular character, with areas of high proportion of fine primary Si, and adjacent transition zones in which the primary Si is diminished or even absent. It may be observed that owing to the relatively short duration of the process at elevated temperatures, final sintered structures of powder metallurgy materials are defined by kinetics rather than by thermodynamic equilibrium, and that reticular structures, as described in WO94/29489, are well known. It is generally observed that bearing materials comprise abrasion-resistant regions to confer wear resistance interspersed with more resilient softer zones, improving pliability. Thus, among the suitable products, especially automotive components, that may be made by the invention are products having a sliding contact bearing surface formed therein, such as a bearing cap for a camshaft or a lightly loaded bushing.

The invention includes the pressed and sintered powder metallurgy product itself. Such a product has a microstructure characterised by interpenetrating reticular structures derived from the original alloy powder particles. The reticular structures include a first structure derived from the first alloy powder, and a second structure derived from the other aluminium-based powders. The product also includes a proportion of zinc, in solution, corresponding to the quantity of the fourth powder contained in the powder mixture before sintering.

The variables hereinbefore described in relation to the materials used in the method of the invention apply equally to the composition of the product, including the stages after sintering, namely oil impregnation, sealing, and anodizing.

BRIEF DESCRIPTION OF THE DRAWINGS

In the accompanying photomicrographs.

EXAMPLE

Figure 3:
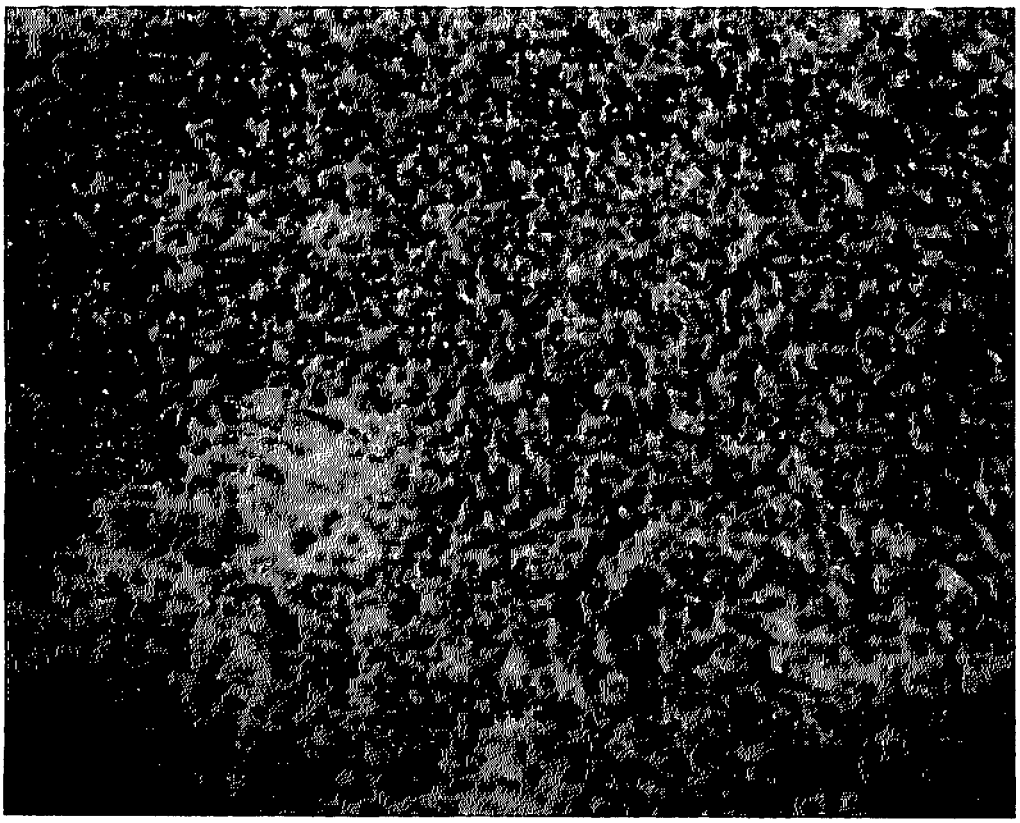
Fig. 3 PRIOR ART

FIG. 3 of WO02/27047 shows that as-atomized powder mixtures of near-eutectic and hypereutectic powders, with Zn addition for sintering, achieve pressed densities of 2.2 $Mg/m^3$ at pressing pressure of 330 MPa, 2.3 $Mg/m^3$ at pressure of 440 MPa, and 2.4 $Mg/m^3$ at about 550 MPa.

In a trial comparison, powder mixtures of the as-atomized Al—Si based powders detailed in Table 1, not having been annealed, were mixed in the proportions given in Table 2, the percentages being by weight, together with 0.35 wt % of fugitive pressing lubricant.

Powder A is an example of a hypereutectic Al—Si powder containing 15.6 wt % Si, given for comparative purposes, not suited for use as one of the powders in the invention. Powder B is the hypereutectic alloy LM30 (B.S. 1490) containing significant copper and magnesium in addition to 17 wt % silicon, and is accordingly suited for use as a first powder in the method of the invention. Powder C is an example of a near-eutectic Al—Si powder, suited for use as a second powder in the method of the invention, containing 10.6 wt % Si. Powder D is substantially pure aluminium (99.7 wt %) and suited for use as a third powder in the method of the invention. Powder E is the low-silicon aluminium-based powder ASM2124, which also contains significant copper and magnesium, and is potentially also suited for use as a third powder.

TABLE 1

| Powder | Si | Cu | Mg | Mn | Al and incidental impurities | Particle size (d50) |
|---|---|---|---|---|---|---|
| A | 15.6% | — | — | — | Balance | 45 μm |
| B (LM30) | 17% | 4% | 0.5% | — | Balance | 65 μm |
| C | 10.6% | — | — | — | Balance | 45 μm |
| D | — | — | — | — | 99.7% | 45 μm |
| E (ASM2124) | 0.1% | 4% | 1.4% | 0.5% | Balance | 25 μm |

The balance includes incidental impurities in each case. (d50) indicates that 50% of the particles can be held up on a screen of the size indicated. Where powders are not screened, d50 may conveniently be determined by laser light scattering particle size analysis. This measure may be used to interpret references herein to "median particle size".

These powders were made up into six different powder mixes, as set out in Table 2. Of these, mix 6 was in conformity with the invention, while mixes 1 to 5 were not, and are included for comparison purposes. The zinc powder particle size was within the range from 30 to 150 micrometres.

TABLE 2

| Mix | A | B | C | D | E | Zn |
|---|---|---|---|---|---|---|
| 1 | 48 (annealed) | — | 48 (annealed) | — | — | 4 |
| 2 | 48 (atomized) | — | 48 (atomized) | — | — | 4 |
| 3 | 32 (atomized) | — | 32 (atomized) | 32 | — | 4 |
| 4 | 32 (atomized) | — | 32 (atomized) | — | 32 | 4 |
| 5 | — | 48 (atomized) | 48 (atomized) | — | — | 4 |
| 6 | — | 32 (atomized) | 32 (atomized) | 32 | — | 4 |

These mixtures were compacted at 550 MPa, giving pressed densities as given in Table 3. The pressed components were subsequently sintered in a nitrogen/5% hydrogen atmosphere, allowing a dwell of about 20 minutes at 350 to 400° C. to de-wax, and a sinter of 20 minutes at 560 to 570° C. After sintering, polished samples of the components were tested for hardness (Hv5). Values were as listed in Table 3.

TABLE 3

| Mix | Pressed density $Mg/m^3$ (% theoretical) | Vickers hardness (Hv5) |
|---|---|---|
| 1 | 2.45 (85%) | 31 |
| 2 | 2.45 (85%) | 31 |
| 3 | 2.58 (93%) | 31 |
| 4 | 2.50 (88%) | 46 |
| 5 | 2.44 (85%) | 78 |
| 6 | 2.58 (93%) | 68 |

In mixes 3 and 6, the addition of the third powder, of elemental aluminium, has restored the pressed density to equal to or better than the pressed density of the annealed powder mixes of WO02/27047. In mix 4, with a different third powder, the pressed density is still improved.

Examples of the microstructures after sintering can be seen in FIGS. 1 to 5.

Figure 1:
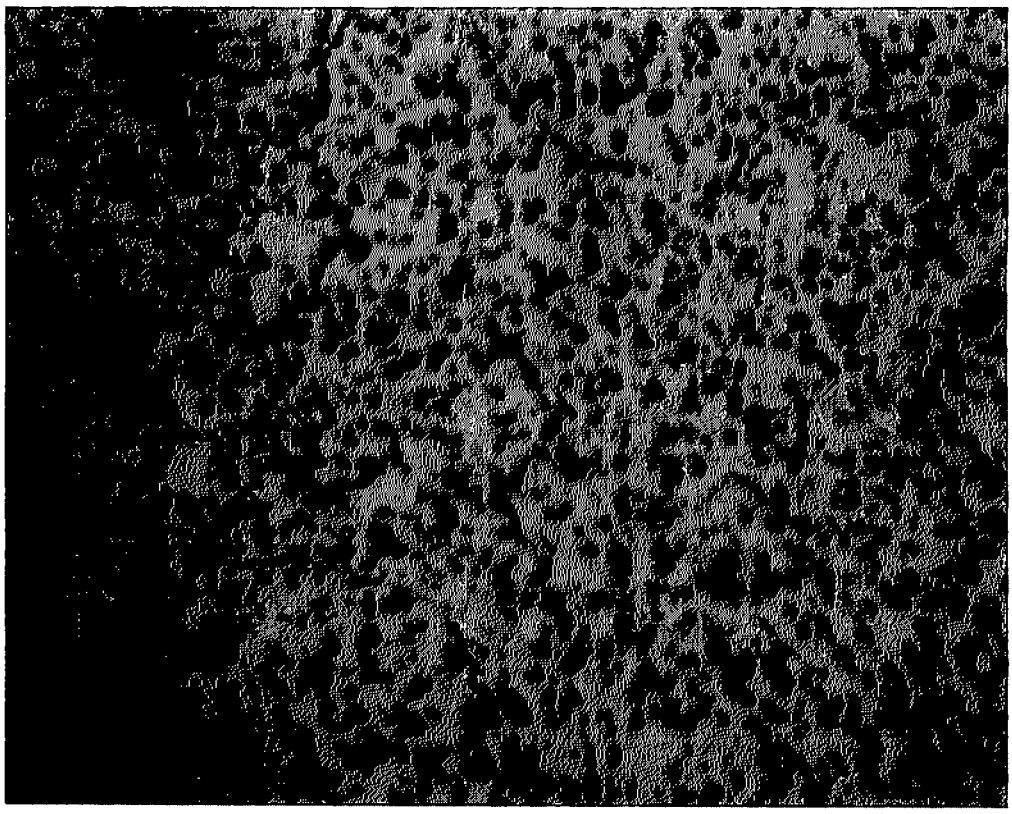
Fig. 1 PRIOR ART
FIGS. 1 to 5 show the microstructures of four aluminium alloy powder metallurgy alloy products according to the prior art. These products were made from mixes 1, 3, 4 and 5 as described in the following illustrative and non-limiting Example.

FIG. 1 (×400) shows a sample made from mix 1. It shows primary silicon particles (grey) in an unresolved eutectic. The continuous porosity, showing as dark linear regions towards the left of the image area, is also evident.

Figure 2:
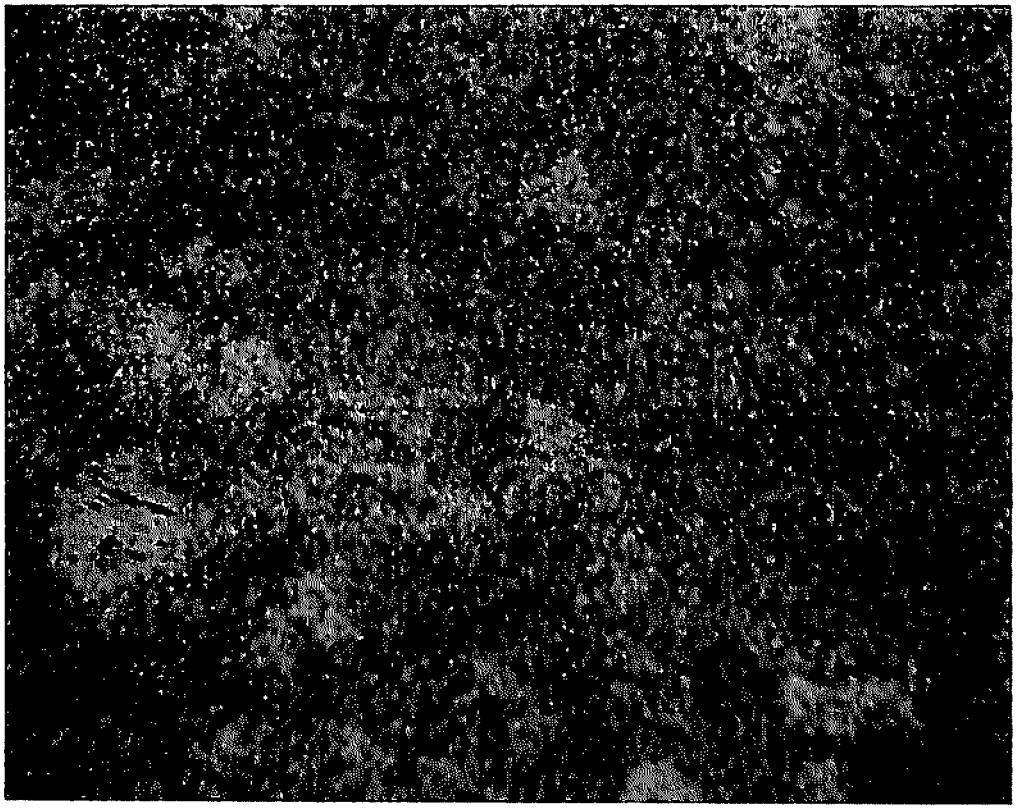
Fig. 2 PRIOR ART

FIG. 2 (×100) and FIG. 3 (×400) show samples made from mix 3. Again these show primary silicon, with a degree of coalescence of the particles evident at ×400. Precipitate-denuded or -free zones demonstrate the reticular nature of the structure, particularly evident at ×100. The dark porosity can be seen to be isolated at ×400, characteristic of density greater than 90% of theoretical.

Figure 4:
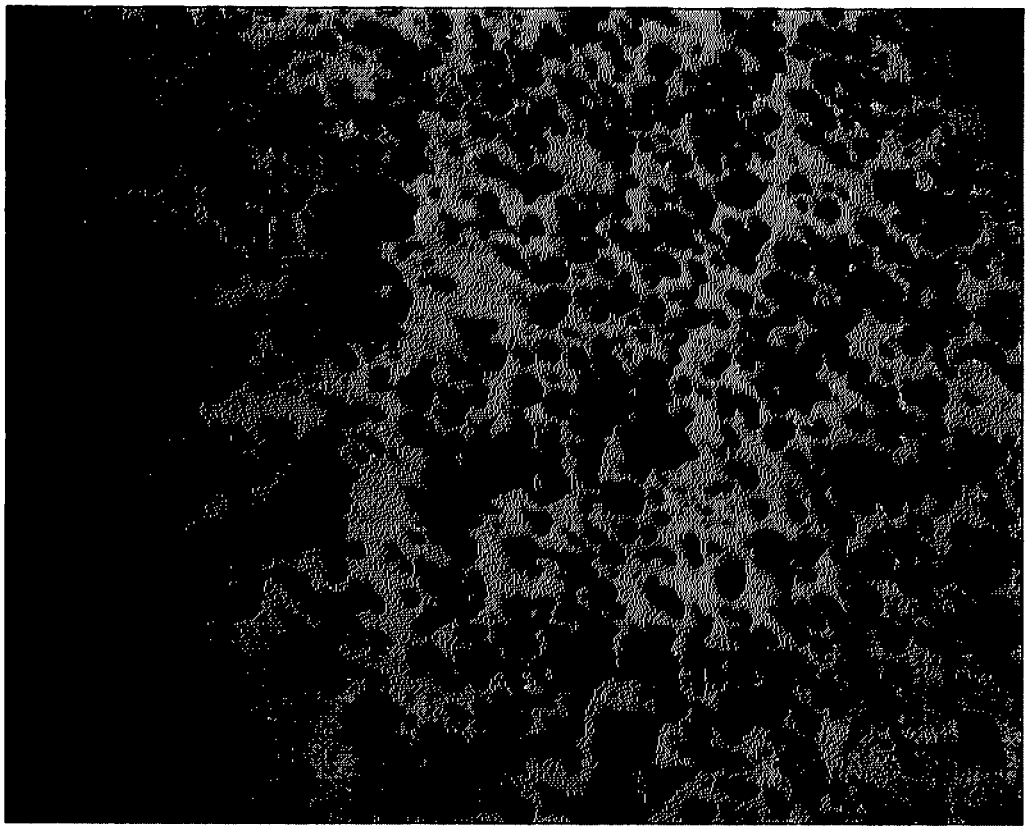
Fig. 4 PRIOR ART

FIG. 4 (×400) shows a sample made from mix 4. The use of Al—Cu—Mg (alloy ASM 2124) as a third powder results in limited hardening. Low density continuous porosity (dark regions) and coarsened silicon particles are evident.

Figure 5:
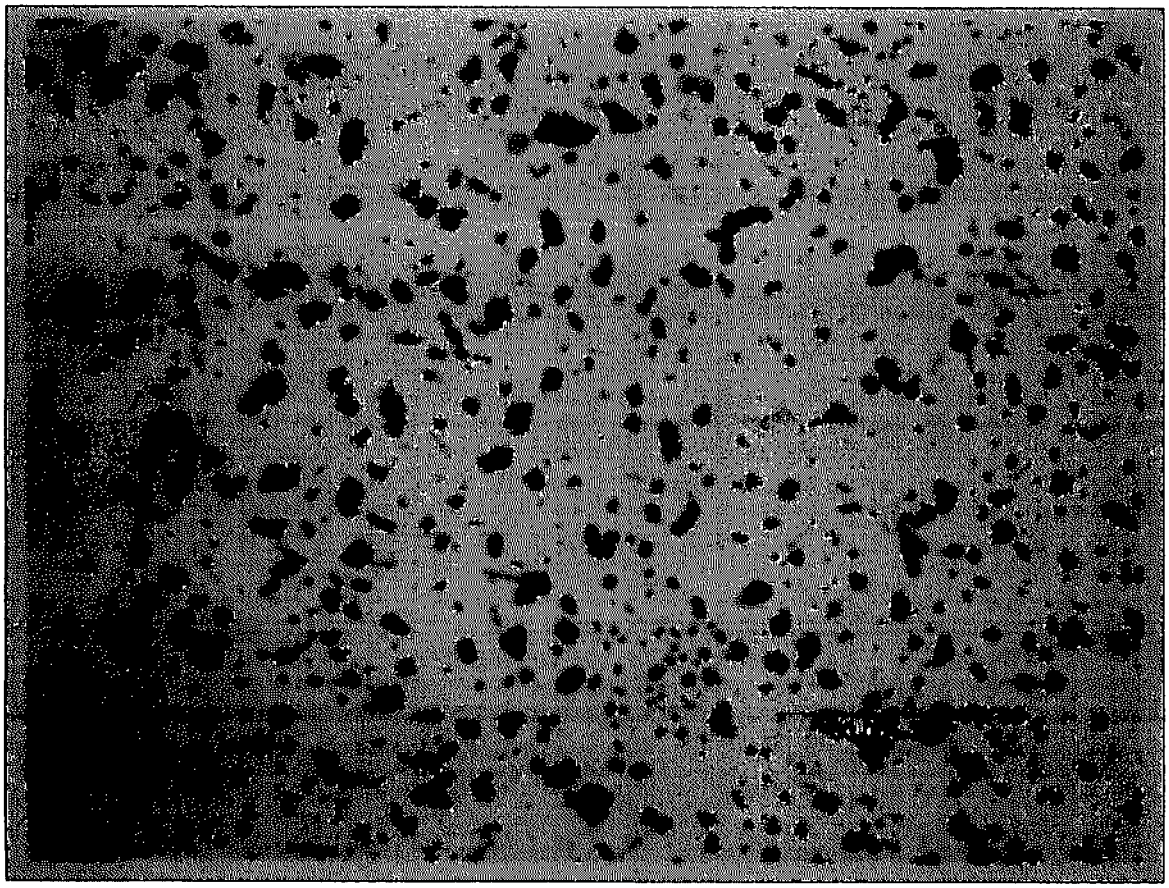
Fig. 5 PRIOR ART

FIG. 5 is a final comparative sample, made from mix 5. The use of LM30 (Al—Si—Cu—Mg powder) reveals fine primary silicon, compatible with raised hardness (Table 3) against an unresolved eutectic. Minor intermetallics and linear porosity may just be discerned in the background.

As regards the hardness values shown in Table 3, it can be seen that the high proportion of Si, Cu and Mg in the hypereutectic powder has allowed a higher hardness than in mixtures including a hypereutectic powder without Cu or Mg. In addition, whereas the simultaneous presence of Si with Cu and Mg in the hypoeutectic case is evidently deleterious to hardness, higher hardness can be achieved with the hypereutectic powder containing Cu and Mg.

The powder mix 6 can be seen, from the foregoing Example, to give rise to numerous particular benefits, both in the methods of making aluminium alloy products provided by the powder metallurgy route of the present invention, and in the products so made, when compared with all the alternative powder mixes.

The products obtained from each of mixes 1, 2 and 3 show low hardness, even though mix 3 allows higher density. The product obtained from mix 4 shows slightly better hardness but not density. The product from mix 5 suffers from lower density in spite of higher hardness through use of Al-17Si-4Cu-1Mg. Only mix 6 gives rise to the triple advantages of a) high density, b) high hardness, and c) reduced cost through the use of as-atomised B and C powders, the cost being further reduced by the use of a substantial proportion of cheaper aluminium powder in the mix.

Other changes and modifications within the scope of the invention will be apparent to those skilled in the art.

The invention claimed is:

1. A metal powder source material for making an aluminium-based sintered product compactable to a pre-sintered density of at least 90% of theoretical by a powder metallurgy route, comprising a mixture of first, second and third aluminium-containing powders mixed with a sintering aid comprising a fourth powder comprising zinc or a zinc based alloy; wherein the first powder is of a hypereutectic aluminum-silicon-copper-magnesium alloy, the second powder is of a near-eutectic aluminium-silicon alloy containing from 9 to 13 wt % silicon, and the third powder is of aluminium; the first and second powders are present in relative proportions to one another lying in the range 35:65 wt % to 65:35 wt %; the third powder is present in a proportion of 5 wt % up to 35 wt % of the total weight of the three said aluminum-containing powders; the fourth powder is present as at least 0.5 wt % of the total metal and alloy powder mixture; and at least the first and second aluminium-containing powders have been produced by an atomizing step and not subsequently annealed.

2. A metal powder source material according to claim 1, wherein the hypereutectic aluminium-silicon-copper-magnesium alloy of the first powder has a copper content of at least 2 wt %.

3. A metal powder source material according to claim 1, wherein the hypereutectic aluminium-silicon-copper-magnesium alloy of the first powder has a magnesium content of at least 0.2 wt %.

4. A metal powder source material according to claim 1, wherein the third powder is present as at least 10% of the total weight of the first three powders.

5. A metal powder source material according to claim 1, wherein the fourth powder comprises 2 to 6 wt % of the total metal powder mixture.

6. A green pressed composite compacted to a pre-sintered density of at least 90% of theoretical formed by shaping and compacting a metal powder source material according to claim 1.

7. A powder metallurgy product obtained from a green pressed composite according to claim 6 by sintering, having a microstructure characterised by interpenetrating reticular structures derived from the original alloy powder particles, including a first structure having primary silicon particles derived from the first alloy powder and a second structure derived from the other aluminium based powders.

8. An automotive component comprising a powder metallurgy product according to claim 7 having a sliding contact bearing surface formed therein.

9. A metal powder source material for making an aluminium-based sintered product compactable to a pre-sintered density of at least 90% of theoretical by a powder metallurgy route, comprising a mixture of first, second and third aluminium-containing powders mixed with a sintering aid comprising a fourth powder comprising zinc or a zinc based alloy; wherein the first powder is of a hypereutectic aluminum-silicon-copper-magnesium alloy, the second powder is of a near-eutectic aluminium-silicon alloy containing from 9 to 13 wt % silicon, and the third powder is of a hypoeutectic aluminium alloy containing alloying constituents other than silicon and from 0.3 wt % to less than 0.6 wt % silicon; the first and second powders are present in relative proportions to one another lying in the range 35:65 wt % to 65:35 wt %; the third powder is present in a proportion of 5 wt % up to 35 wt % of the total weight of the three said aluminium-containing powders; the fourth powder is present as at least 0.5 wt % of the total metal and alloy powder mixture; wherein at least the first and second aluminium-containing powders have been produced by an atomizing step and not subsequently annealed.

10. A metal powder source material according to claim 9, wherein the hypereutectic aluminium-silicon-copper-magnesium alloy of the first powder has a copper content of at least 2 wt %.

11. A metal powder source material according to claim 9, wherein the hypereutectic aluminium-silicon-copper-magnesium alloy of the first powder has a magnesium content of at least 0.2 wt %.

12. A metal powder source material according to claim 9, wherein the third powder is present as at least 10% of the total weight of the first three powders.

13. A metal powder source material according to claim 9, wherein the fourth powder comprises 2 to 6 wt % of the total metal powder mixture.

14. A green pressed composite compacted to a pre-sintered density of at least 90% of theoretical formed by shaping and compacting a metal powder source material according to claim 9.

15. A powder metallurgy product obtained from a green pressed composite according to claim 14, by sintering having a microstructure characterised by interpenetrating reticular structures derived from the original alloy powder particles, including a first structure having primary silicon particles derived from the first alloy powder and a second structure derived from the other aluminium based powders.

16. An automotive component comprising a powder metallurgy product according to claim 15, having a sliding contact bearing surface formed therein.

* * * * *